US006688720B2

(12) United States Patent
Imanaka et al.

(10) Patent No.: US 6,688,720 B2
(45) Date of Patent: Feb. 10, 2004

(54) INK JET RECORDING HEAD, MANUFACTURING METHOD OF SAME, INK JET RECORDING APPARATUS AND INK JET RECORDING HEAD DRIVING METHOD

(75) Inventors: Yoshiyuki Imanaka, Kawasaki (JP); Takeshi Okazaki, Sagamihara (JP); Teruo Ozaki, Yokohama (JP); Muga Mochizuki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/895,075

(22) Filed: Jul. 2, 2001

(65) Prior Publication Data

US 2002/0024550 A1 Feb. 28, 2002

(30) Foreign Application Priority Data

Jun. 30, 2000 (JP) ..... 2000-199510

(51) Int. Cl.[7] ..... B41J 2/01
(52) U.S. Cl. ..... 347/19
(58) Field of Search ..... 347/9, 14, 17, 347/19

(56) References Cited

U.S. PATENT DOCUMENTS

| | | | | |
|---|---|---|---|---|
| 5,175,565 A | | 12/1992 | Ishinaga et al. | |
| 5,852,369 A | * | 12/1998 | Katsuma | 324/678 |
| 5,886,713 A | | 3/1999 | Okada et al. | |
| 5,943,069 A | | 8/1999 | Kamiyama et al. | |
| 6,168,251 B1 | | 1/2001 | Imanaka et al. | |

FOREIGN PATENT DOCUMENTS

EP 0 709 196 5/1996

* cited by examiner

*Primary Examiner*—Craig Hallacher
(74) *Attorney, Agent, or Firm*—Fitzpatrick, Cella, Harper & Scinto

(57) ABSTRACT

An ink jet recording head includes a plurality of recording elements arranged in an array on a substrate, the recording elements having electric resistances with a variance not less than 4% from a resistance value of at least one of the recording elements, wherein the recording elements generate ink ejection energy to effect printing; a plurality of measuring elements, disposed adjacent at least each of the opposite ends of the array of the recording elements, for detesting characteristic values of the recording elements; and a storing section for storing an average, a median or a reference value corresponding thereto.

55 Claims, 13 Drawing Sheets

INK JET RECORDING HEAD, MANUFACTURING METHOD OF SAME, INK JET RECORDING APPARATUS AND INK JET RECORDING HEAD DRIVING METHOD

FIELD OF THE INVENTION AND RELATED ART

The present invention relates to an ink jet recording head for effecting image or the like printing by ejecting ink onto a recording material, a manufacturing method for the same, an ink jet recording apparatus and a driving method for an ink jet recording head. More particularly, it relates to an ink jet recording head in which a proper amount of energy is supplied to a recording element for generating energy contributable to ink ejection, a manufacturing method of the same, an ink jet recording apparatus using the same and actuating or driving method for the same.

A recording apparatus such as a printer, a copying machine, a facsimile machine or the like, or a recording apparatus as outputting equipment of a work station or a combined system including a computer, word processor or the like, effects recording of an image or the like on a recording sheet such as a sheet of paper, plastic thin plate (OHP for example) in accordance with image information. The recording apparatus is classified, depending on the recording method using recording means, into an ink jet type, a wire dot type, a thermosensitive type, a thermal transfer type, a laser beam type or the like.

Among them, the ink jet type recording device (ink jet recording apparatus) uses a recording means (recording head) from which the ink is ejected onto the recording sheet. This type is advantageous in that the size of the recording means is small, that high-speed printing with high resolution is possible, that plain paper is usable without special treatment thereto, that running cost is low, that noise is low (non-impact type), and color image printing is easy using a plurality of colors of ink.

The ink jet recording type is further classified into various types, in one of which a heat generating element is provided in a nozzle and is actuated to produce heat which is used to eject the ink (bubble jet recording system). The recording element for generating the energy to eject the ink can be manufactured through a semiconductor manufacturing process. Therefore, the recording head or the Bubble Jet type comprises an element substrate made of silicon substrate, a recording element formed thereon and a top plate of resin material such as polysulfone or glass or the like having grooves therein which constitute ink passages.

In some of the recording heads of this type, drivers for driving the recording elements, temperature sensors for controlling the recording elements in accordance with head temperatures and a drive control portion or the like are formed on the element substrate as well utilizing the material (silicon substrate) of the element substrate.

FIG. 9 shows an example of a substrate for the recording head.

In FIG. 9, formed in the element substrate 900 are a plurality of juxtaposed heat generating elements (recording elements) 901 for applying thermal energy for ink ejection, a power transistor (driver) 902 for driving the heat generating elements 901, a shift register 904 for receiving serial image data supplied from an external device, a serial clock in synchronism therewith to receive the image data of 1 line at a time, a latching circuit 903 for latching the image data of one line outputted from the shift register 904 in synchronism with the latching clock signals and for parallel transfer thereof to the power transistor 902, a plurality of AND gates 915, provided corresponding to each of the power transistors 902, for applying output signals of the latching circuit 903 to the power transistor 902 in accordance with external enabling signals 908, and input contacts 905–912 for inputting the image data and various signals from the outside.

On the element substrate 900, there are formed a temperature sensor reference numeral 914 for measuring a temperature of the element substrate 900 and a heater for heating the element substrate on the basis of the temperature detection of the element substrate 900 by the temperature sensor. U.S. Pat. No. 5,175,565, for example, discloses an element substrate in which the temperature sensor and the heater are built-in at the opposite outside portions of a recording element array. With this structure, the problem of such a temperature distribution of the element substrate 900 as will lead to unstable ink ejection can be avoided. That is, the temperature distribution is detected by the temperature sensor, and in response to the detection, the heater is actuated to correct the temperature distribution of the temperature. Thus, stabilized ink ejection is accomplished. A recording head having on the element substrate the driver, the temperature sensor, the drive control portion and so on, has been put into practice, and is advantageous in the reliability and the downsizing of the apparatus.

With this structure, the image data inputted as the serial signal are converted to the parallel signals by the shift register 904, and are outputted and retained by the latching circuit 903 in synchronism with the latching clock signals. In such state, when a driving pulse signal for the heat generating element 901 (enabling signal 908 for the AND gate 915) is inputted through the input contact 908, the power transistor 902 is actuated in accordance with the image data to supply the electric current to the corresponding heat generating element 901, thus heating the ink in the liquid flow path (nozzle), by which the ink is ejected in the form of a droplet through the nozzle.

However, the ink jet recording heads include differences among individuals due to the tolerances during the manufacturing step, and therefore, the driving voltage applied to a recording element may be higher than a driving voltage supplying a proper amount of energy with a result of shorter service life than expected, or conversely, the driving voltage applied to the recording element is smaller than the driving voltage supplying the proper amount of energy with a result of ejection defect.

U.S. Pat. No. 5,943,069 proposes using the temperature control heater as a resistance sensor, and the resistance of the heater is detected, and on the basis of the detected resistance, a proper driving voltage to be applied to the heat generating element 901 is selected. U.S. Pat. No. 5,943,069 also discloses that in consideration of the possibility that when the size of the substrate (element substrate) is large, because of variations of the resistance values of the heat generating elements (recording elements), a resistance sensor is built-in at each of opposite outside portions of the recording element array. The resistances of the resistance sensors are sequentially detected, and on the basis of the output, the driving voltage to be applied to the recording element is selected.

Recently, the number of nozzles of a recording head has increased in order to raise the recording speed, to such an extent that the length of the array of the nozzles (recording width) is 100 mm, or 200 mm (full-line type). However, in the development of long recording heads, it has turned out that the above-mentioned problems arise again when the recording width is increased. More particularly, even if the resistance sensors as disclosed in said U.S. Pat. No. 5,943,069 are used, some of the recording elements have shorter service lives, or some other recording elements have ejection defects.

The inventors first thought that problems could be solved by special use of the resistances of the two resistance sensors, although U.S. Pat. No. 5,943,069 did not disclose how to use the resistances sequentially detected by the two resistance sensors.

The inventors have noted the possibility that variations in the resistances of the recording elements are greater when the size of the substrate is large as pointed out by U.S. Pat. No. 5,943,069, and the inventors experiments and considerations have revealed that if the variations relative to a sheet resistance value is approx. 4%, the problems of the short service life and ejection defect do not arise, and the recording heads are practically operable.

Description will be made as to the nature of the variations in the resistances of the recording elements, which arise during the manufacturing step.

In order to produce a heat generating element on the substrate for the ink jet recording head, particularly one which ejects the ink by the generation of a bubble using a heat generating element (recording element), a heat generation layer is formed on a wafer having a diameter of 125 mm (5 inches) or 150 mm (6 inches) or the like, and the heat generation layer is patterned into a proper shape.

FIG. 10 is a graph showing a change of a sheet resistance (broken line) in a cross-section A—A on the wafer having the heat generation layer on its surface. The variation is created mainly by variations in the film thickness when the film is formed, or variations in the composition or the like in the wafer surface. The difference between the maximum resistance and the minimum resistance is approx. 10–15%. Referring to FIG. 10, the characteristics of the variation (broken line) of the sheet resistance will be described. In the circumference portion of the wafer 2001 indicated by hatched lines, the difference is large. This is because the film formation speed and/or the film formation condition tend to vary more in the circumference portion than in the central portion of the wafer during the film formation.

Referring to FIG. 11, the cutting out of the substrate having a recording width of a conventional size (10 mm) from the wafer will be described. FIG. 12 schematically shows the case in which a larger size substrate (20 mm) is cut out. These Figures show a concept of variations in the resistances of the recording elements in substrates having different sizes (recording widths).

In the conventional structure, the electric energization time (period) has been determined on the basis of the value detected by a measurement element at one point. Therefore, the recording elements away from the resistance sensor are supplied with excessively large or small energy, and excessiveness increases with the distance from the resistance sensor. Therefore, the reduction of the service life and the ejection failure occur more frequently in the more distant recording elements.

FIG. 13 shows variations (%) in the resistances of the recording elements relative to the resistance value of the measurement resistance in the conventional size (10 mm) (recording width) substrate and a large size (20 mm) substrate, which have been cut out of a central portion of the wafer in which the variations in the sheet resistance of the heat generating element is relatively small. As shown in FIG. 13, the variation in the conventional size substrate is approx. 1%, and the variation in the large size substrate is approx. 3%; therefore, the variations are not larger than 4%. Therefore, in the center portion region of the wafer, the influence of the sizes are not serious, and therefore, the produced substrates are satisfactory.

FIG. 14 shows variations (%) in the resistance values of the recording element relative to the measurement resistance, as to the conventional size (10 mm) substrate and the large size (20 mm) substrate, which have been cut out of the peripheral portion of the wafer in which the variations in the sheet resistance of the heat generating element are relatively large. As shown in FIG. 14, the variations in the conventional size substrate are approx. 4% at the maximum, and therefore are satisfactory. However, the large size substrate exhibits approx. 8% variations, which means that there are probabilities of shorter service life or ejection failure. This is a cause of reduction of the yield in the substrate manufacturing.

SUMMARY OF THE INVENTION

Accordingly, it is a principal object of the present invention to provide an ink jet recording head, an ink jet recording head manufacturing method, an ink jet recording apparatus and a driving method for an ink jet recording head wherein even if the recording width is relatively large, and therefore, the variations in the resistances of the recording elements are relatively large, the yield of the substrates is not degraded, and the service life can be maintained, and the ejection defect can be avoided.

According to an aspect of the present invention, there is provided an ink jet recording head comprising:

a plurality of recording elements arranged in an array on a substrate, said recording elements having electric resistances with a variance not less than 4% from a resistance value of at least one of said recording elements, wherein the recording elements generate ink ejection energy to effect printing;

a plurality of measuring elements, disposed adjacent at least each of the opposite ends of the array of said recording elements, for detecting characteristic values of said recording elements; and storing means for storing an average, a median or a reference value corresponding thereto.

According to this aspect of the present invention, the variations of the resistances of the recording elements relative to the reference value can be made approx. one half the conventional variations. Therefore, even if the size of the substrate is relatively large, the variations can be reduced, and therefore the problems of short service life and the ejection defect can be avoided.

It may be that the characteristic values are resistances of said measuring elements.

It may be that said recording elements comprise heat generating elements.

It may be that the array of the recording elements has a length not less than 20 mm.

It may be that an additional measuring element is disposed between said measuring elements disposed adjacent to the ends of the array of the recording elements.

It may be that measuring element contacts are connected to opposite ends of each of the measuring elements.

It may be that a measuring element contact is connected to one end of each of the measuring electrodes disposed adjacent the opposite ends of the array of the recording elements.

It may be that the resistance of the wiring is not more than 1/10 a total of the resistances of the measuring electrodes.

It may be that said array of the recording elements is divided into a plurality of groups of said recording elements, and said plurality of measuring elements for detecting characteristic values of said recording elements are disposed at least at the opposite ends of the respective groups of the recording elements.

It may be that at least one recording element driving signal contact is connected to each of the groups of said recording elements to supply driving signals for generating the ejection energy to said recording elements therein with the same pulse width to cause said recording elements to generate ink ejection energy.

It may be that the groups of the recording elements have a length not less than 20 mm.

According to another aspect of the present invention, there is provided an ink jet recording head comprising:

a plurality of recording elements arranged in an array on a substrate, said recording elements having electric resistances with a variance not less than 4% from a resistance value of at least one of said recording elements, wherein the recording elements generate ink ejection energy to effect printing;

a plurality of measuring elements, disposed adjacent at least each of the opposite ends of the array of said recording elements, for detecting characteristic values of said recording elements;

wherein outputs of said measuring elements are used to determine amounts of electric energy of driving signals to be supplied to said recording elements to generate the ejection energy.

According to this aspect of the present invention, even if the size of the substrate is relatively large, the influence of the variations of the resistances of the recording elements can be reduced. Thus, a larger size of the substrate is usable.

It may be that an average, a median or a reference value corresponding thereto of the characteristic values is used for determining the amounts of the electric energy.

It may be that the characteristic values are resistances of said measuring elements.

It may be that said recording elements comprises heat generating elements.

It may be that the array of the recording elements has a length not less than 20 mm.

It may be that an additional measuring element is disposed between said measuring elements disposed adjacent to the ends of the array of the recording elements.

It may be that measuring element contacts are connected to opposite ends of each of the measuring elements.

It may be that a measuring element contact is connected to one end of each of the measuring electrodes disposed adjacent the opposite ends of the array of the recording elements.

It may be that the resistance of the wiring is not more than 1/10 a total of the resistances of the measuring electrodes.

It may be that said array of the recording elements is divided into a plurality of groups of said recording elements, and said plurality of measuring elements for detecting characteristic values of said recording elements are disposed at least at the opposite ends of the respective groups of the recording elements.

It may be that at least one recording element driving signal contact is connected to each of the groups of said recording elements to supply driving signals for generating the ejection energy to said recording elements therein with the same pulse width to cause said recording elements to generate ink ejection energy.

It may be that the amounts of the electric energy of the driving signals to be supplied to said recording elements are capable of being controlled for respective groups.

It may be that the amounts of the electric energy of the driving signals to be supplied to said recording elements are the same within the respective groups.

It may be that the ink jet recording head further comprises storing means for storing an average, a median or a reference value corresponding thereto.

It may be that the characteristic values are resistances of said measuring elements.

It may be that said recording elements comprise heat generating elements.

It may be that the groups of the recording elements have a length not less than 20 mm.

It may be that an additional measuring element is disposed between said measuring elements disposed adjacent to the ends of the array of the recording elements.

It may be that measuring element contacts are connected to opposite ends of each of the measuring elements.

It may be that a measuring element contact is connected to one end of each of the measuring electrodes disposed adjacent the opposite ends of the array of the recording elements.

It may be that the resistance of the wiring is not more than 1/10 a total of the resistances of the measuring electrodes.

According to a further aspect of the present invention, there is provided a manufacturing method for an ink jet recording head including a substrate having a plurality of recording elements arranged in an array on a substrate and a plurality of measuring elements, disposed adjacent at least each of the opposite ends of the array of said recording elements, for detecting characteristic values of said recording elements; and storing means for storing an average, a median or a reference value corresponding thereto, wherein the recording elements generate ink ejection energy to effect printing, said method comprising:

a step of detecting the characteristic values;

a step of calculating an average, a median or a reference value corresponding thereto from the characteristic values;

a step of storing in the storing means the average, the median or the reference value.

According to the manufacturing method for the ink jet recording head according to this aspect of the present invention, the ink jet recording head with suppressed variations of the resistances of the recording elements can be manufactured. In addition, it is not necessary to select the substrates depending on the variations of the resistances of the recording elements, and therefore, the manufacturing cost can be reduced.

It may be that a variance of electric resistances of the recording elements is not less than 4% from resistance value of at least one of said recording elements.

It may be that the characteristic values are resistances of the measuring elements.

It may be that the recording elements and the measuring elements are produced in the same process step.

It may be that the array of the recording elements has a length not less than 20 mm.

It may be that an additional measuring element is disposed between said measuring elements disposed adjacent to the ends of the array of the recording elements.

It may be that measuring element contacts are connected to opposite ends of each of the measuring elements.

It may be that a measuring element contact is connected to one end of each of the measuring electrodes disposed adjacent the opposite ends of the array of the recording elements.

It may be that the resistance of the wiring is not more than 1/10 a total of the resistances of the measuring electrodes.

It may be that said array of the recording elements is divided into a plurality of groups of said recording elements, and said plurality of measuring elements for detecting characteristic values of said recording elements are disposed at least at the opposite ends of the respective groups of the recording elements.

It may be that at least one recording element driving signal contact is connected to each of the groups of said recording elements to supply driving signals for generating the ejection energy to said recording elements therein with the same pulse width to cause said recording elements to generate ink ejection energy.

It may be that the groups of the recording elements have a length not less than 20 mm.

According to a further aspect of the present invention, there is provided an ink jet recording apparatus comprising:

an ink jet recording head including a plurality of recording elements arranged in an array on a substrate, said recording elements having electric resistances with a variance not less than 4% from a resistance value of at least one of said recording elements, wherein the recording elements generate ink ejection energy to effect printing; a plurality of measuring elements for detecting characteristic values of said recording elements;

characteristic value detecting means for detecting characteristic values of said measuring elements;

calculating means for obtaining an average, a median or a reference value corresponding thereto from the characteristic value; and driving signal supply means for determining amounts of electric energy of driving signals to be supplied to said recording elements to generate the ejection energy on the basis of the average, the median or the reference value corresponding thereto and for supplying in the driving signals to said recording elements.

It may be that said characteristic values are resistances of the measuring electrodes.

It may be that said apparatus further comprises storing means for storing the average, the median or the reference value.

It may be that said array of the recording elements is divided into a plurality of groups of said recording elements, and said plurality of measuring elements for detecting characteristic values of said recording elements are disposed at least at the opposite ends of the respective groups of the recording elements.

It may be that at least one recording element driving signal contact is connected to each of the groups of said recording elements to supply driving signals for generating the ejection energy to said recording elements therein with the same pulse width to cause said recording elements to generate ink ejection energy.

It may be that the groups of the recording elements have a length not less than 20 mm.

According to a further aspect of the present invention, there is provided a driving method for an ink jet recording head including a substrate having a plurality of recording elements arranged in an array on a substrate, said recording elements having electric resistances with a variance not less than 4% from a resistance value of at least one of said recording elements, wherein the recording elements generate ink ejection energy to effect printing; and a plurality of measuring elements, disposed adjacent at least each of the opposite ends of the array of said recording elements, for detecting characteristic values of said recording elements, said method comprising:

a step of detecting characteristic values of the measuring elements, from which an average, a median or a reference value corresponding thereto is obtained;

a step of determining amounts of electric energy of driving signals to be supplied to the recording elements to generate the ejection energy on the basis of the average, the median or the reference value responding thereto; and a step of supplying the driving signals having the amounts of electric energy thus determined to the recording elements.

According to an aspect of the present invention, optimum amounts of electric energy can be supplied to the recording elements, and therefore, the damage to the recording elements and/or ink ejection defect due to the shortage of the energy can be avoided.

It may be that said recording head further includes storing means for storing the average, the median or the reference value corresponding thereto, said method further comprising a step of reading the average, the median or the reference value corresponding thereto out of said storing means before said determining step.

It may be that the characteristic values are resistances of the measuring elements.

It may be that said array of the recording elements is divided into a plurality of groups of said recording elements, and said plurality of measuring elements for detecting characteristic values of said recording elements are disposed at least at the opposite ends of the respective groups of the recording elements.

It may be that at least one recording element driving signal contact is connected to each of the groups of said recording elements to supply driving signals for generating the ejection energy to said recording elements therein with the same pulse width to cause said recording elements to generate ink ejection energy.

It may be that the groups of the recording elements have a length not less than 20 mm.

It may be that the amounts of the electric energy of the driving signals to be supplied to said recording elements are capable of being controlled for respective groups.

It may be that the amounts of the electric energy of the driving signals to be supplied to said recording elements are the same within the respective groups.

According to an aspect of the present invention, the variations of the resistances of the recording elements relative to the resistance value can be made one half the conventional variations. Therefore, even if the size of the substrate is relatively large, the influence of the variations in the resistances is small, and therefore, the problems of the short service life of the recording head and/or the recording defect due to the shortage of the energy can be avoided. Simultaneously, the yield of the recording head manufacturing can be increased, and the manufacturing cost can be reduced.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Next, embodiments of the present invention will be described with reference to the appended drawings.

Figure 1:
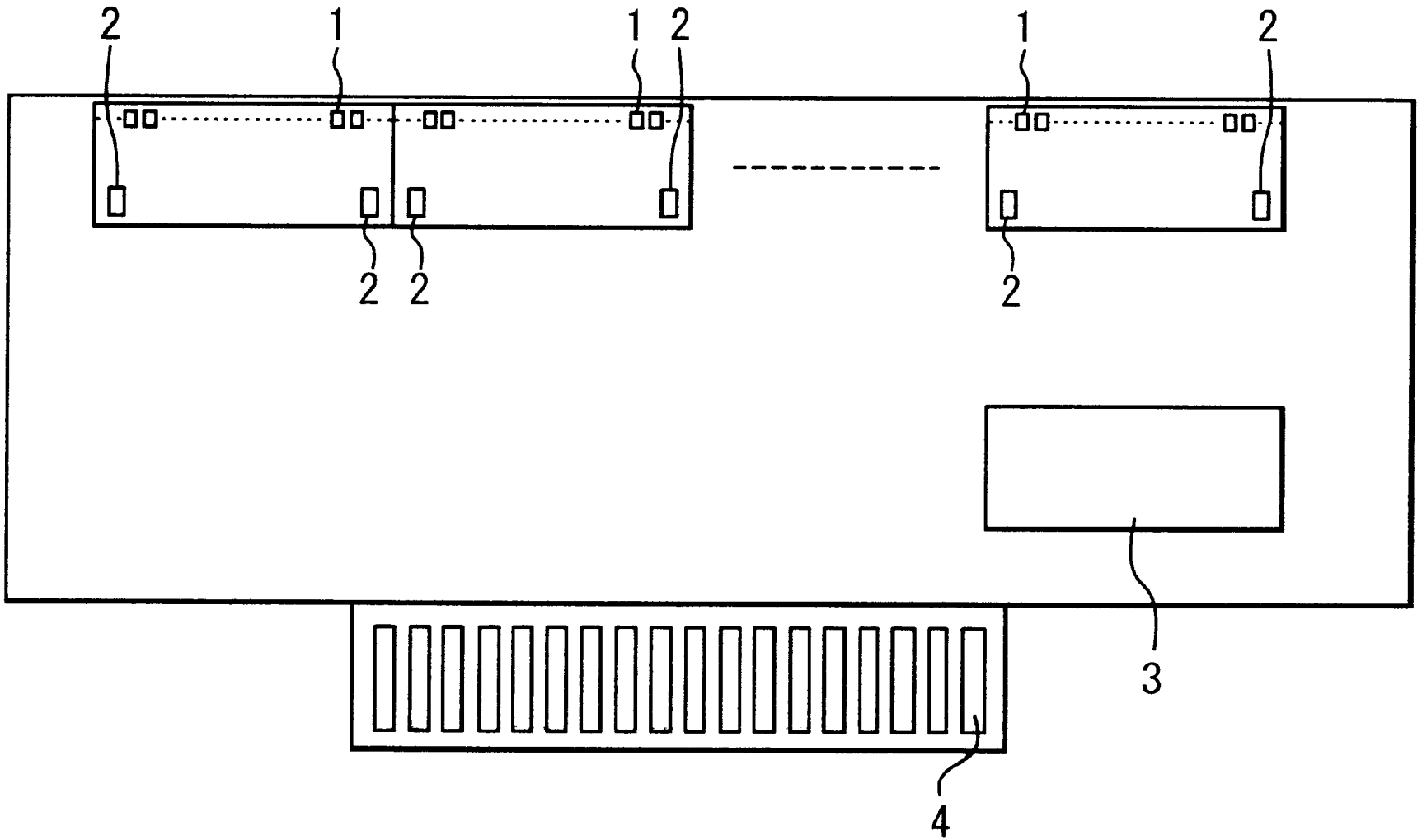
FIG. 1 is a top plan view of a substrate for an ink jet recording head according to an embodiment of the present invention.

FIG. 1 is a plan view of an ink jet recording head chip (substrate) employed by an ink jet recording head, in accordance with the present invention.

As shown in the FIG. 1, the ink jet recording head chip comprises an array of recording elements 1 aligned in a single straight line and an array of measurement elements 2 used for obtaining the properties (in particular, resistance value) of the recording elements 1. The recording elements 1 and measurement elements 2 are formed on a piece of substrate, or a wafer, through the same manufacturing process. Each recording element 1 has a heat generating member which generates heat as electrical energy is supplied thereto.

The array of recording elements 1 is divided into a plurality of cells, each of which comprises a predetermined number of recording elements 1. Each ink jet recording head chip comprises a minimum of one, preferably, a plurality of cells (cell-1–cell-n) as shown in FIG. 1. Each cell comprises a minimum of two measurement elements 2, and in each cell, one measurement element 2 is disposed adjacent each end portion of the recording element array in the cell, with respect to the recording element alignment direction. The number of cells into which the array of recording elements 1 is divided is determined by how many recording elements 1 are placed in a single cell. However, the chip is provided with a minimum of one cell (in this case, there is no division). Each cell is contiguous with adjacent cells, and the direction in which the cells are aligned is the same as the direction in which the recording elements 1 are aligned, as shown in FIG. 1.

Further, the chip is provided with a memory 3, in which the average, median, or referential value equivalent to the average or median, of the resistance values of the two measurement elements 2 of each cell is stored. The chip is also provided with a head contact 4, which is connected to a contact (unshown), with which a recording apparatus, into which a recording head equipped with this chip is mounted, is provided. As the head contact is connected to the contact on the recording apparatus side, it becomes possible for electrical power and recording element driving signals to be supplied to the chip from the recording apparatus, and also for information to be exchanged between the chip and recording apparatus.

Figure 2:
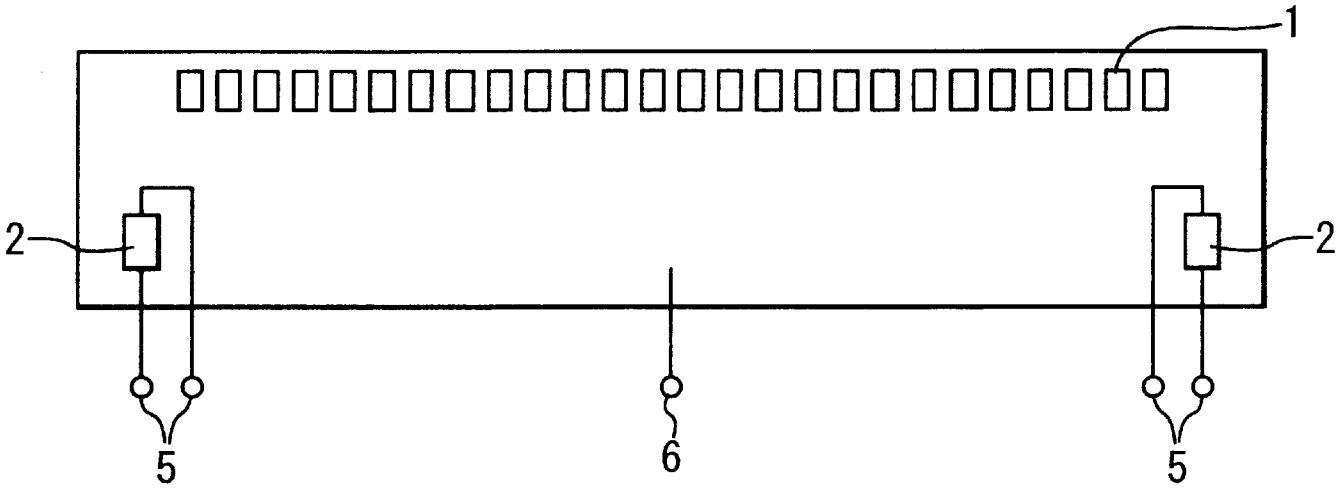
FIG. 2 is a top plan view of one cell on the substrate shown in FIG. 1.

FIG. 2 is a plan view of one of the cells on the chip shown in FIG. 1.

As described above, each cell comprises an array of a predetermined number of recording elements 1, and at least a pair of measurement elements 2, which are disposed adjacent the two recording elements at the two end portions of the recording element array, one for one, with respect to the recording element alignment direction, in each cell. The two measurement elements 2 are the same in shape. The two ends of each measurement element 2 with respect to the direction perpendicular to the recording element alignment direction are connected to a pair of measurement element terminals 5, one for one, which are used as terminals when measuring the resistance of the element 2. Further, each cell is provided with a minimum of one recording element driving signal terminal 6, which is structured so that electrical energy for making each recording element 1 generate ink ejection energy is supplied to each recording element 1 for a duration of a predetermined length, which is the same for all recording elements 1 in the same cell (driving signals supplied to the recording elements 1 in the same cell are the same in pulse width regardless of the recording element to which they are supplied). In the case of the cell shown in FIG. 2, its dimension in terms of the recording element alignment direction (lengthwise direction) is approximately 20 mm.

In order to supply each recording element 1 with a proper amount of electrical energy, the electrical energy supplied to the recording element 1 through the recording element driving signal terminal 6 is regulated by controlling the length of time the recording element driving signal terminal 6 is kept activated, while keeping the voltage constant. In other words, the recording element driving signal terminal 6 determines the length of time electrical energy is supplied. Although FIG. 2 shows the structure in which each cell is provided with a single driving signal terminal 6, it is not mandatory that the number of the driving signal terminal 6 is one, as long as the same amount of electrical energy is supplied to all the recording elements in the same cell, that is, the same portion of the recording element array.

Figure 3:
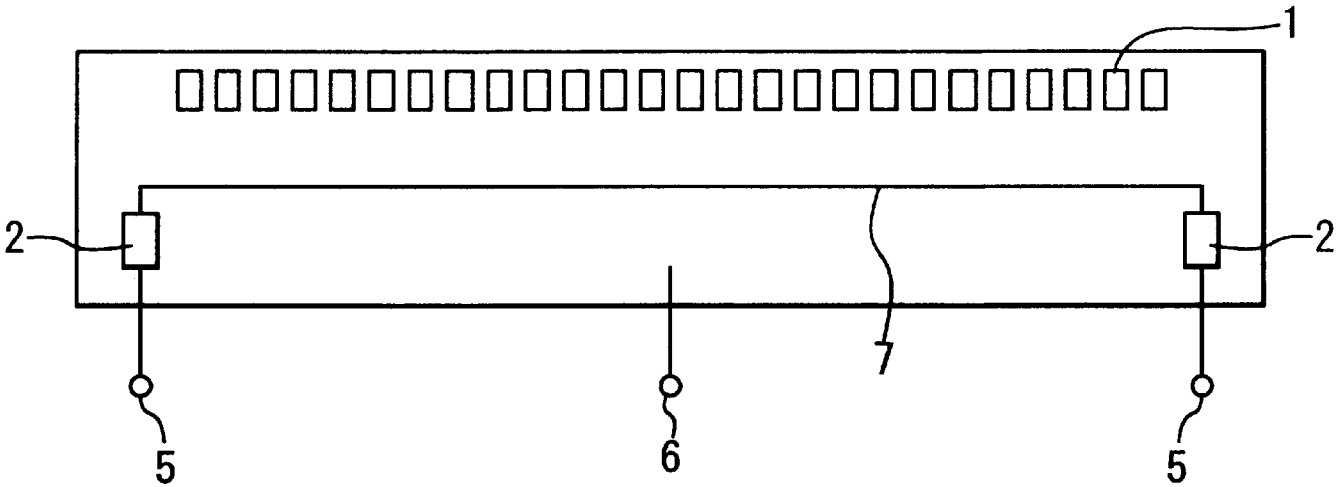
FIG. 3 illustrates measuring elements of the cells, which are connected through wiring within the substrate.

Referring to FIG. 2, in order to prevent the increase in the number of various terminals connected to each cell, it is desired that the size of each cell is no less than 20 nm, and each cell is provided with two measurement terminals located adjacent the recording elements at the two end portions of the recording element array, one for one, in terms of the recording alignment direction, in the cell. In FIG. 2, the cell is structured so that each end of each measurement element 2 is connected to its own terminal 5. However, each may be structured as shown in FIG. 3, in which one end of one of the two measurement elements 2 positioned adjacent the two recording elements at the aforementioned two end portions of the recording element array, one for one, in terms of the recording element alignment direction, in each cell, is connected to the corresponding end of the other measurement element in the same cell, through a wire 7, and the other ends of the two measurement elements 2 are connected to their own terminals 5, as shown in FIG. 3, so that the number of the terminals 5 can be halved. In the case of the structural arrangement shown in FIG. 3, there is a possibility that the resistance value of the wire 7 which connects the two measurement elements 2 to each other has a variation of approximately 10% or more, which may cause noise. Thus, the ratio of the resistance value of the wire 7 relative to the total resistance value of the two measurement elements 2 in each should be reduced to 1/10 or less, that is, a ratio at which the variation in the electrical resistance of the wire 7 is insignificant in practical terms.

Figure 4:
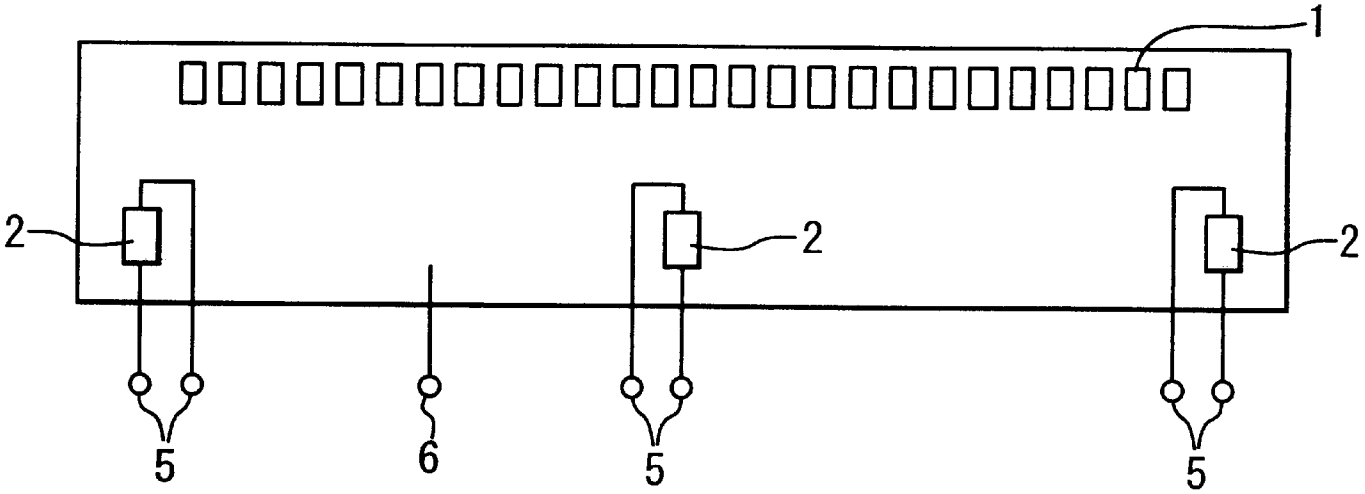
FIG. 4 shows an example in which an additional measuring element is provided at the center between the end measuring electrodes.
Figure 5:
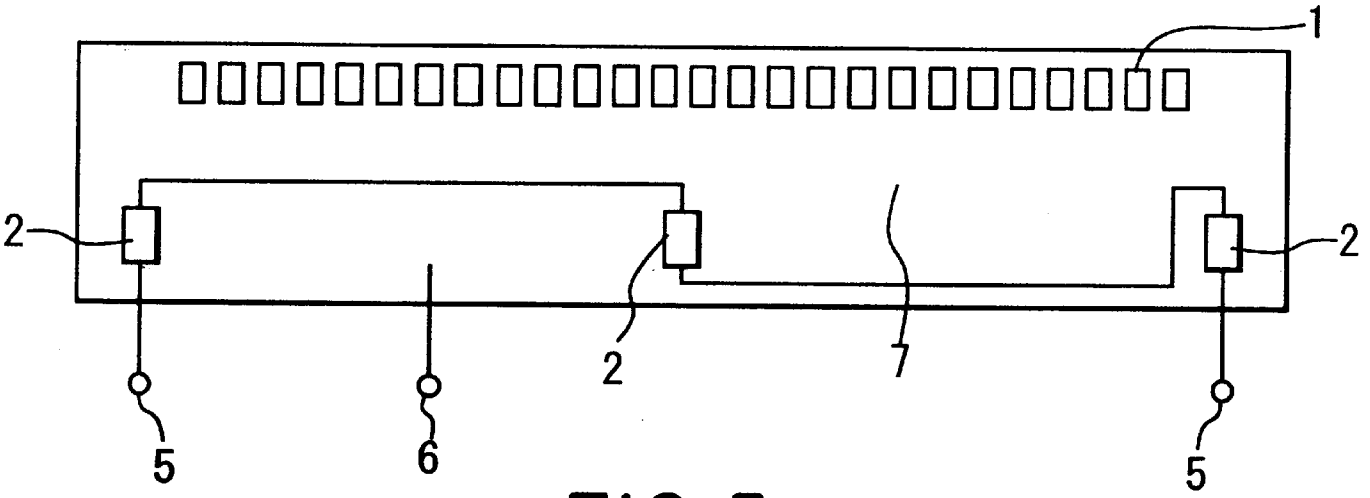
FIG. 5 shows an example in which an additional measuring element is provided at the center between the end measuring electrodes.
Figure 10:
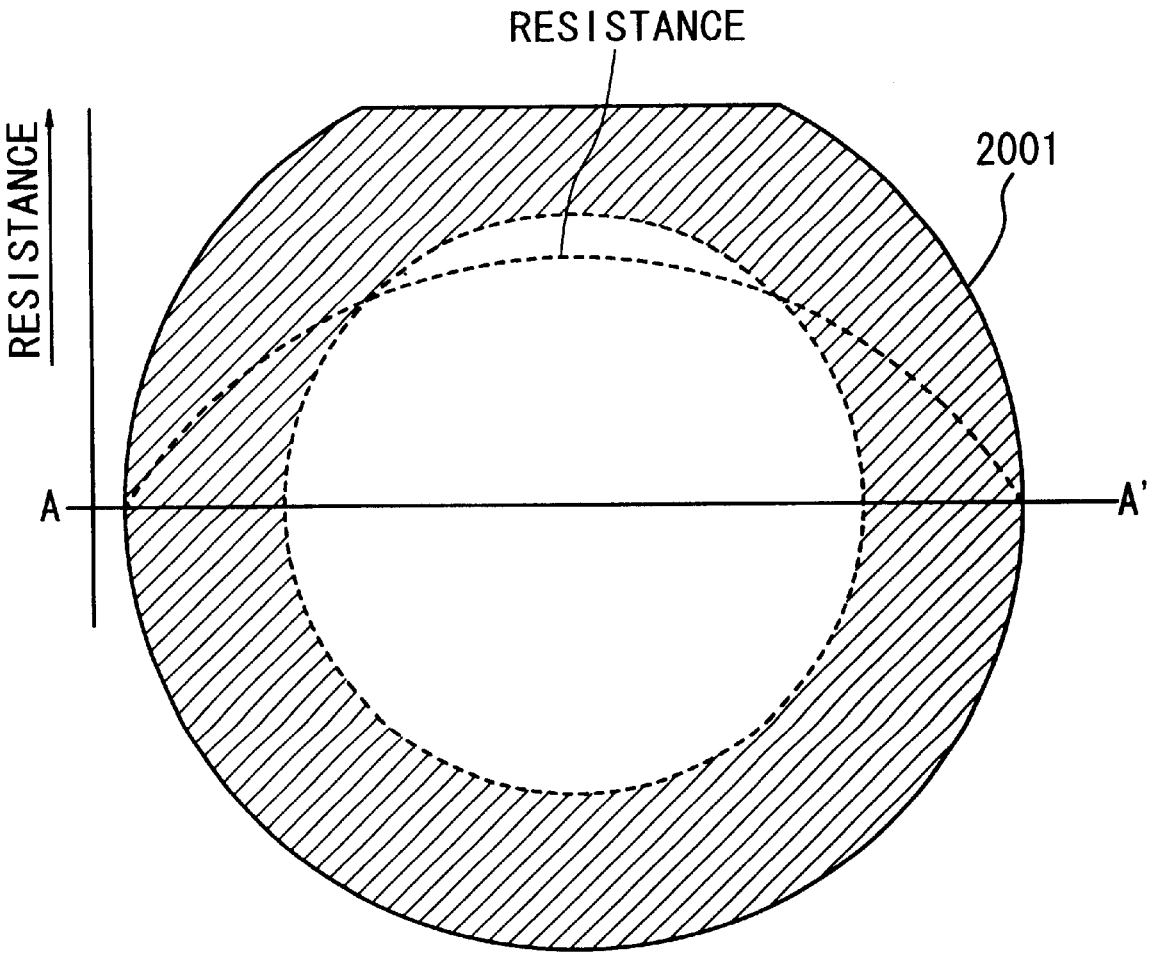
FIG. 10 is a graph of a distribution of the sheet resistance in a cross-section taken along a line A—A on the wafer on which a heat generation layer is formed.
Figure 11:
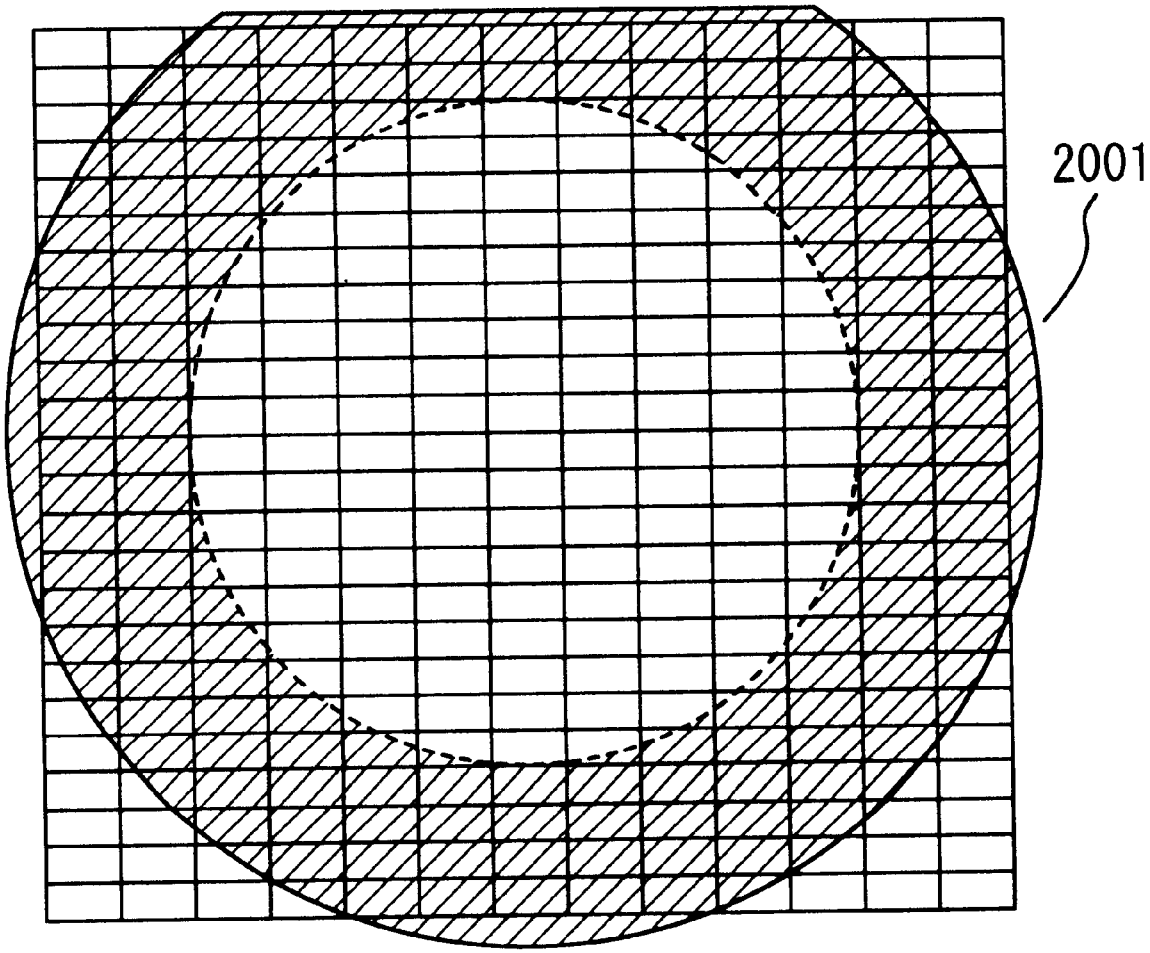
FIG. 11 shows cutting the substrate for the conventional recording width from the wafer shown in FIG. 10.
Figure 12:
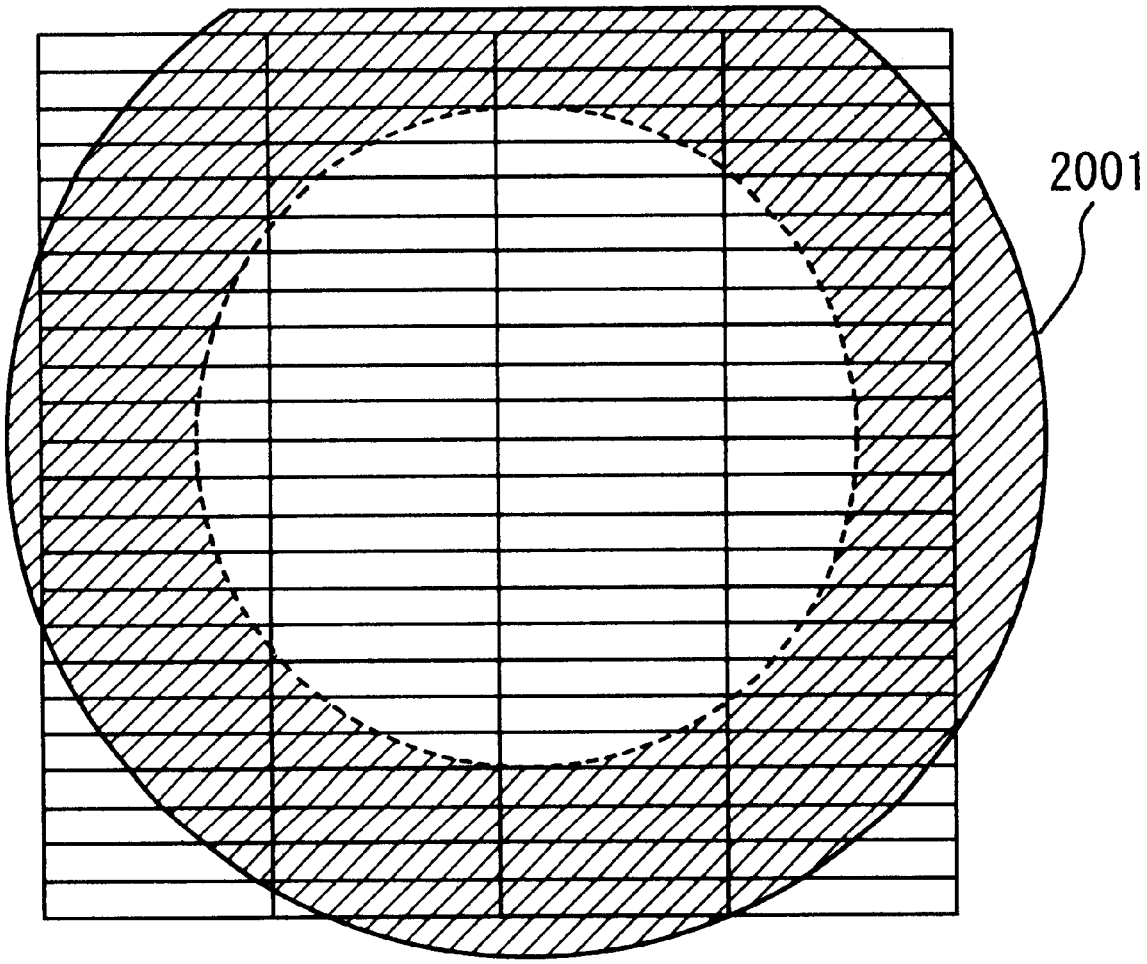
FIG. 12 shows cutting of a substrate for a larger recording width from the wafer shown in FIG. 10.
Figure 13:
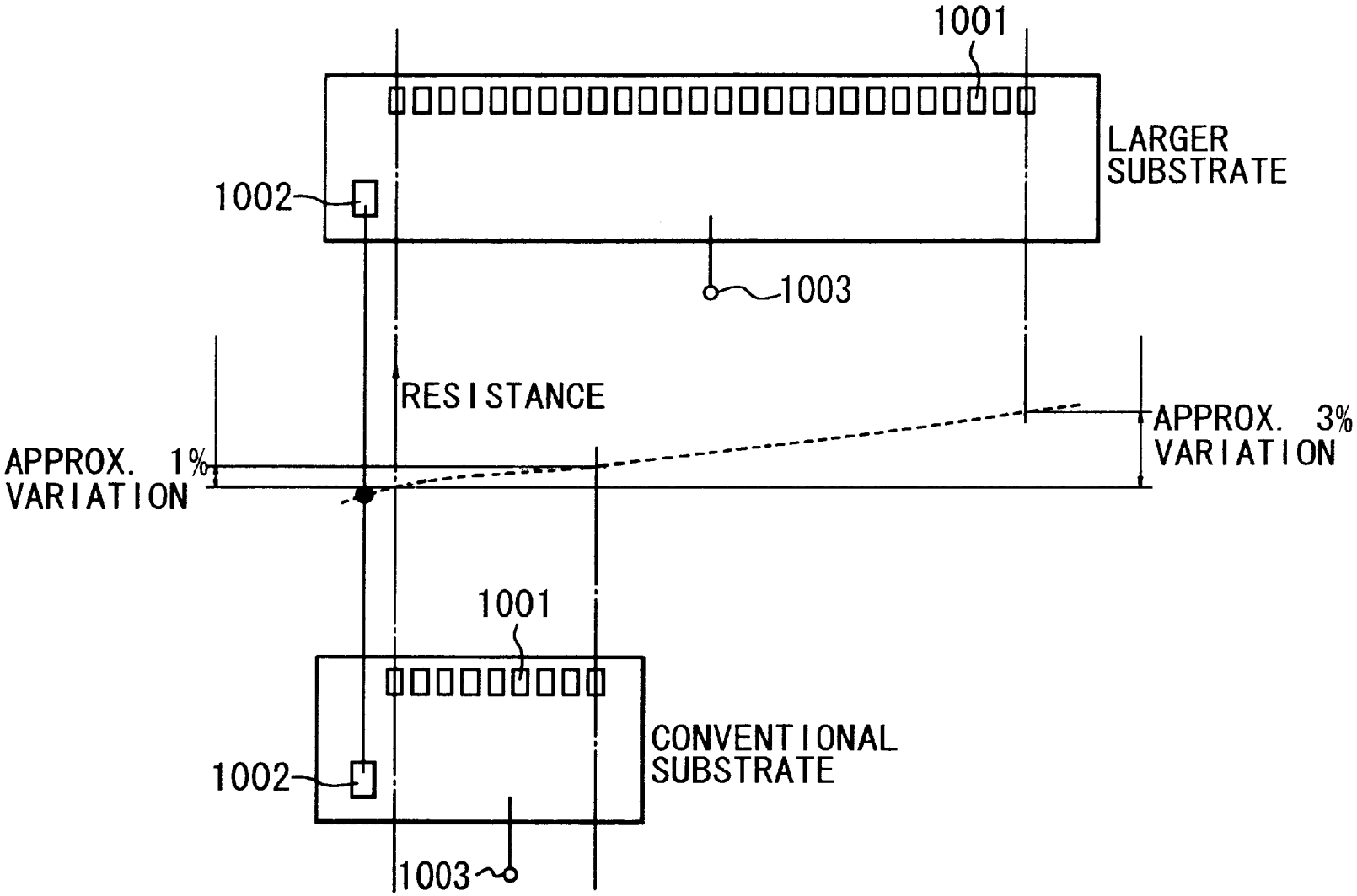
FIG. 13 shows variation (%) in the resistances of the recording elements relative to the resistance value of the measurement resistance in the conventional size (10 mm) (recording width) substrate and a large size (20 mm) substrate, which have been cut out of a central portion of the wafer in which the variations in the sheet resistance of the heat generating element are relatively small.
Figure 14:
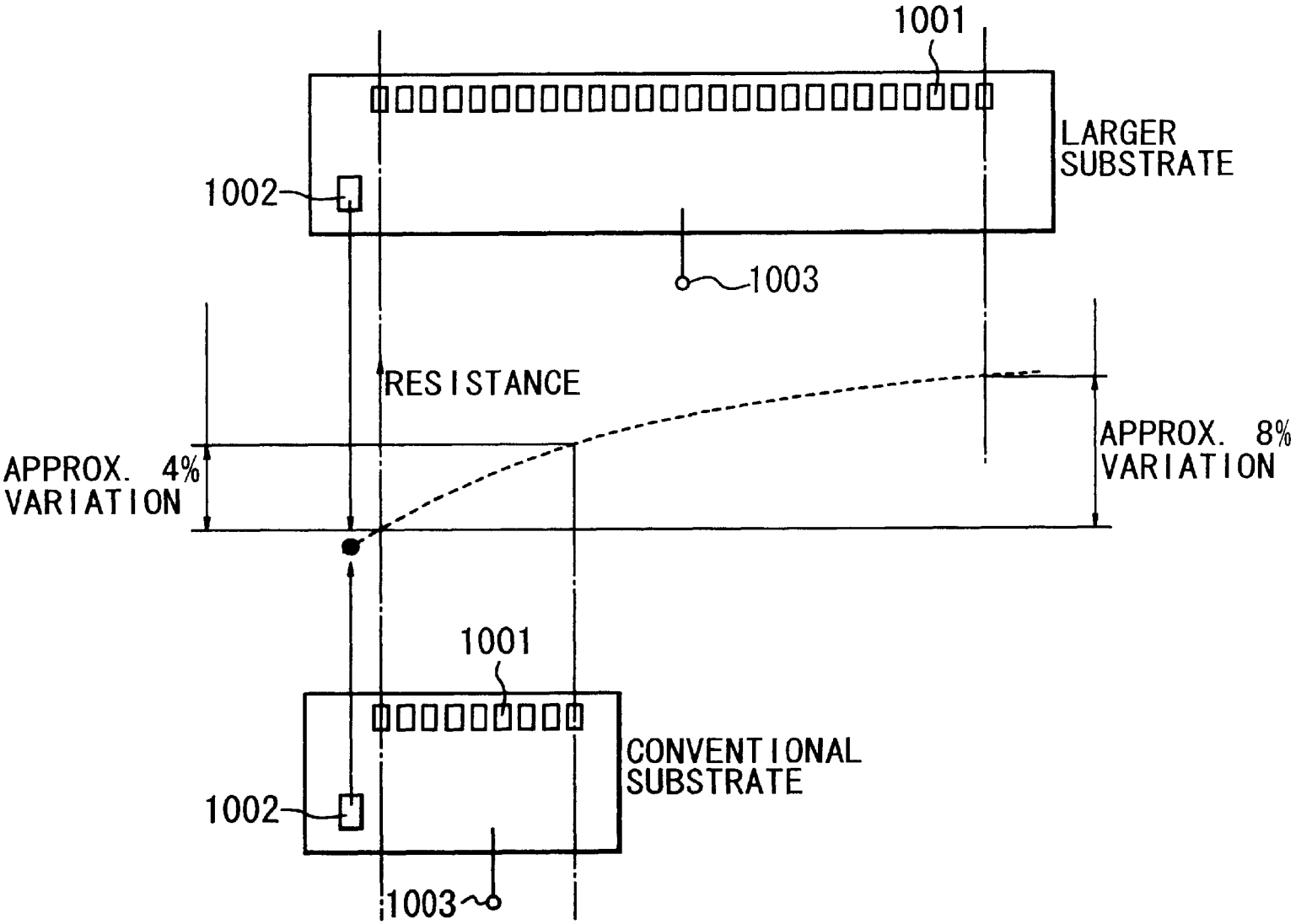
FIG. 14 shows variations (%) in the resistance values of the recording element relative to the measurement resistance, as to the conventional size (10 mm) substrate and the large size (20 mm) substrate, which have been cut out of the peripheral portion of the wafer in which the variations in the sheet resistance of the heat generating element are relatively large.

In this embodiment, it is assumed that the variation in electrical resistance across a wafer, in terms of the radial direction, that is, the direction from the center of the wafer to its peripheries, is unidirectional, as shown in FIG. 10. Therefore, each cell is structured as shown in FIG. 2 or 3, in which the two measurement electrodes 2 are disposed at the end portions, one for one, of the cell in terms of the recording element alignment direction. However, if the wafer resistance variation in terms of the direction from the center of the wafer to its periphery is not unidirectional, it is recommended that another measurement element 2 be placed in the middle between the two measurement elements 2 located at the two ends of the cell, one for one, as shown in FIG. 4 or 5. In any case, what is important here is that two or more measurement elements 2 are disposed in such a manner that the maximum and minimum resistance values in terms of the variation of the resistance within each cell are captured by the measurement elements 2.

At this time, referring to FIG. 8, the definition and significance of "median" in the specific property (resistance) of the measurement element 2 will be described.

Figure 8:
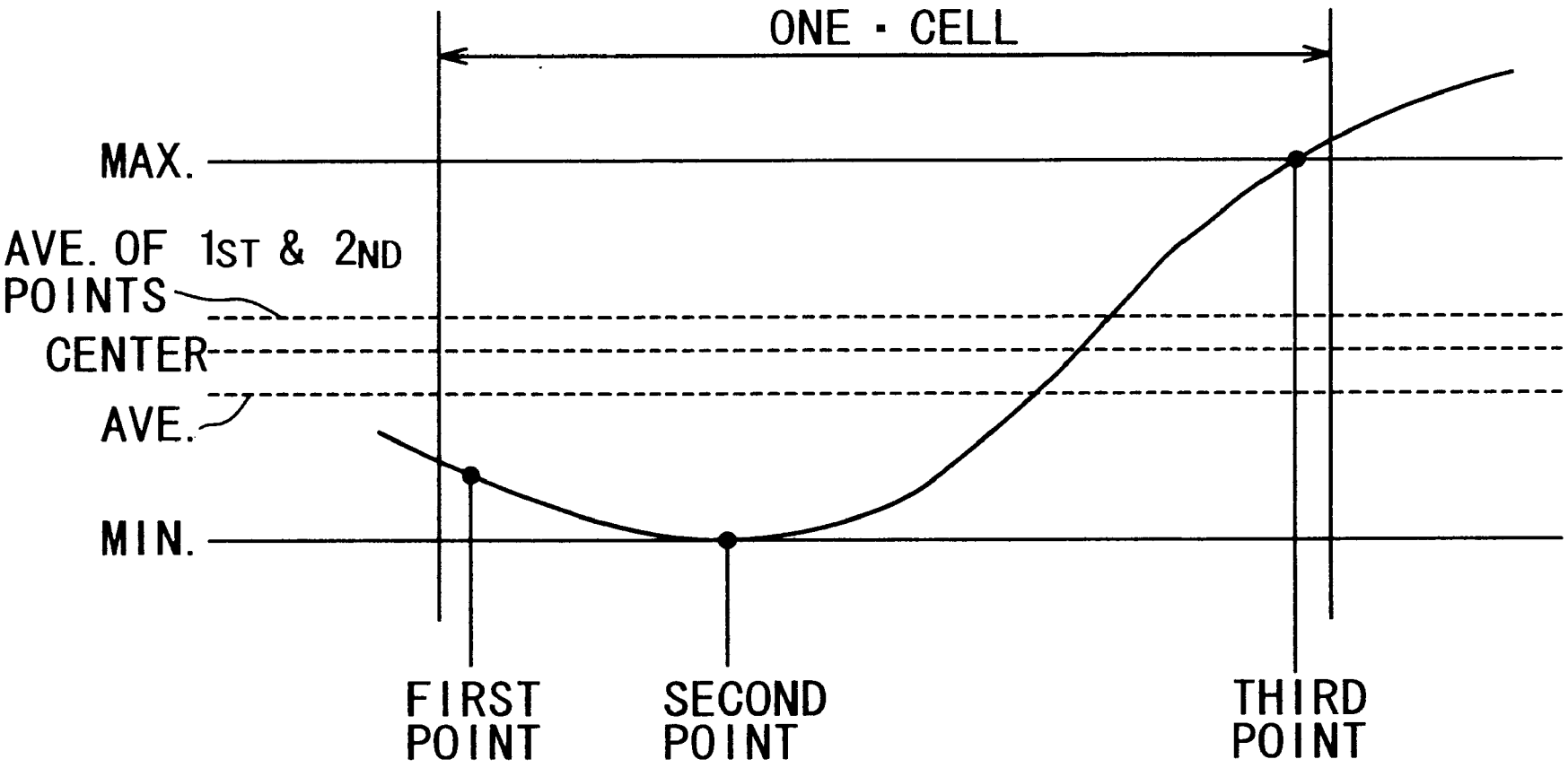
FIG. 8 illustrates a "center portion value" of a characteristic value of the measuring element.
Figure 9:
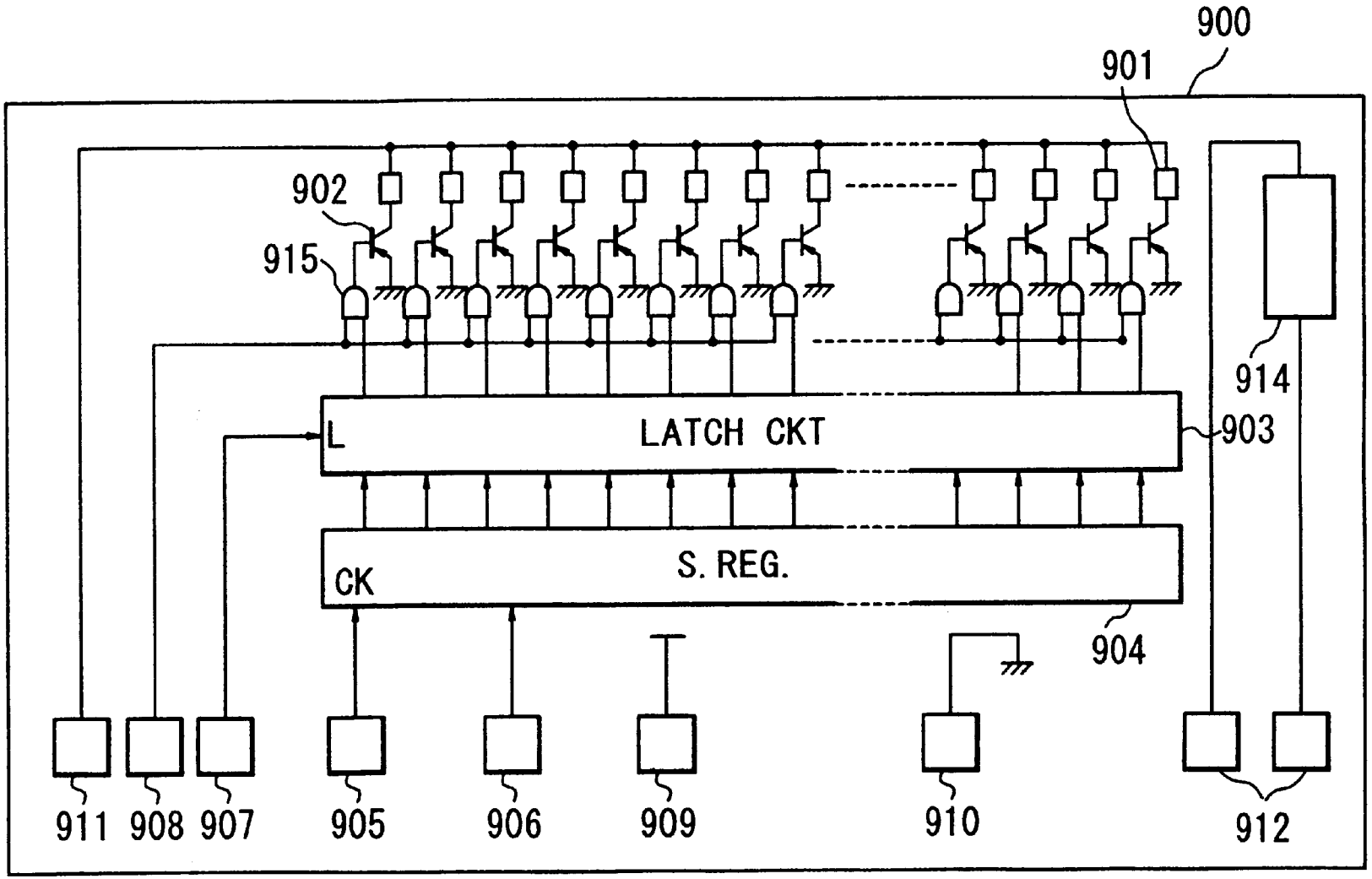
FIG. 9 shows a conventional substrate for a recording head.

FIG. 8 shows a case in which the variance in resistance in a cell, in terms of the radial direction of a wafer on which the cell has been formed, is not undirectional, and in which the resistance of three measurement elements 2 are measured (FIG. 1). The term "median" in this specification means the middle resistance value between the largest and smallest resistance values. In comparison, the term "average" means the average of the resistance values of all the measurement elements 2, the resistance of which is measured. Thus, when the number of the measurement elements 2 is two, "median" and "average" coincide.

When the variance in resistance in a given cell is as shown in FIG. 8, if the average of the resistance values of the cell measured at first and second points, that is, the end portions of the cell, is used as the referential resistance value of the call, the variance of the referential resistance value relative to the resistance value of the cell measured at a second measurement point becomes larger than if the median among resistance values obtained at first, second, and third measurement points is used as the referential resistance value of the cell. In other words, if the average of the resistance values obtained at the first and third measurement points is used as the referential resistance value, excessive amount of energy is supplied to the recording elements adjacent the second measurement point at which the resistance value was smallest, reducing, therefore, the durability of the recording elements. Thus, when the resistance is measured at three or more points, it is desired that the "median" of the resistance values obtained at the three or more points be used as the referential resistance value.

Referring to FIG. 1, the recording head chip is provided with the memory 3 as storage means for storing the average, median, or the referential value equivalent to the average or median, of the measured resistance values of the two measurement elements 2 disposed as shown in the drawing. This memory 3 may be a memory element mounted on the recording head chip, or may be an integrally formed part of the chip. Further, the memory 3 may be disposed in the recording head into which the recording head chip is assembled, instead of being mounted on the recording head chip.

At this time, an ink jet recording head equipped with the above-described ink jet recording head chip, a manufacturing method of the ink jet recording head, and an ink jet recording apparatus into which the recording head is mounted will be described.

An ink jet recording head structured in accordance with the present invention comprises: the above-described recording head chip; a plurality of ejection orifices for ejecting ink; a plurality of liquid paths which are connected to the plurality of ejection orifices, one for one, and in which the above-described plurality of recording elements are disposed, one for one. The ink jet recording head structured as described above is driven by a driving method, which will be described later, so that ink is ejected from the ejection orifices in such a manner as to form an image on recording medium such as a recording sheet.

This ink jet recording head is structured so that the driving signals supplied to each recording element 1 can be adjusted in the amount of electrical energy for each cell; it is possible to equalize all the cells in the amount of the electrical energy of the driving signal supplied to each cell.

The ink jet recording head in accordance with the present invention is manufactured through a manufacturing method comprising: a process in which one of the properties (which is resistance in this embodiment) of each measurement element 2 is measured; a process in which the average, median, or the referential value equivalent to the average or median, is computed from the measured values in one of the properties; and a process in which the computed average, median, or the referential value equivalent to the average or median, is stored in the memory 3 as a storage means.

The ink jet recording apparatus structured in accordance with the present invention comprises: an ink jet recording head structured as described above; a measuring means for measuring the measurement element 2 in the value of one of the properties thereof; a computing means for obtaining the average, median, or the referential value equivalent to the average or median, from the measured values in one of the properties of all the measurement elements 1 in each cell; and a driving signal supplying means which determines the amount of the electrical energy of the driving signal supplied to each recording element 1 based on the average, median, or the referential value equivalent to the average or median, obtained by the computing means, and supplies each recording element 1 with a driving signal with the determined amount of electrical energy.

Figure 6:
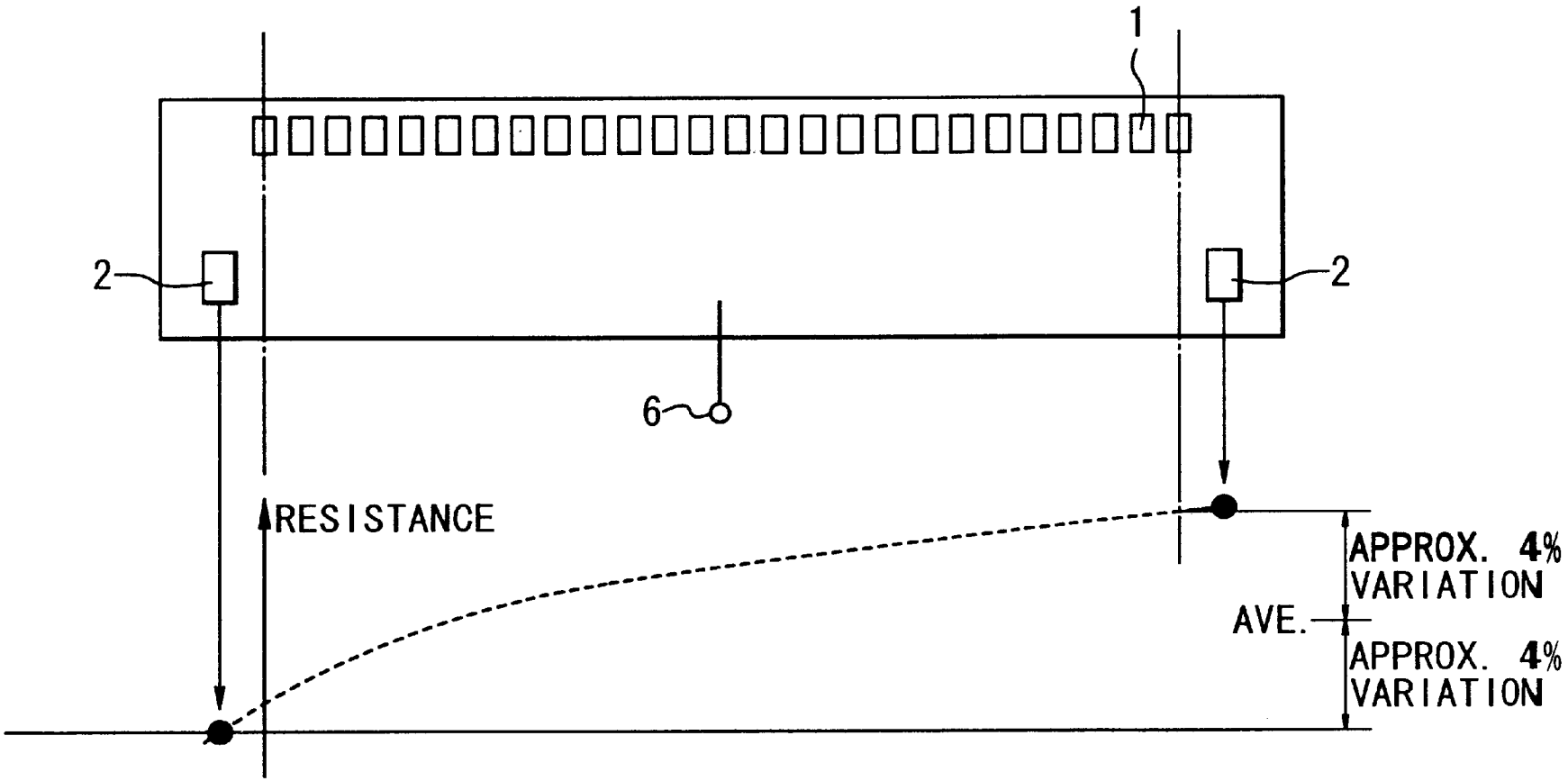
FIG. 6 shows a distribution of sheet resistance values in one cell, resistance values of the measuring elements and calculated variations in the resistances.
Figure 7:
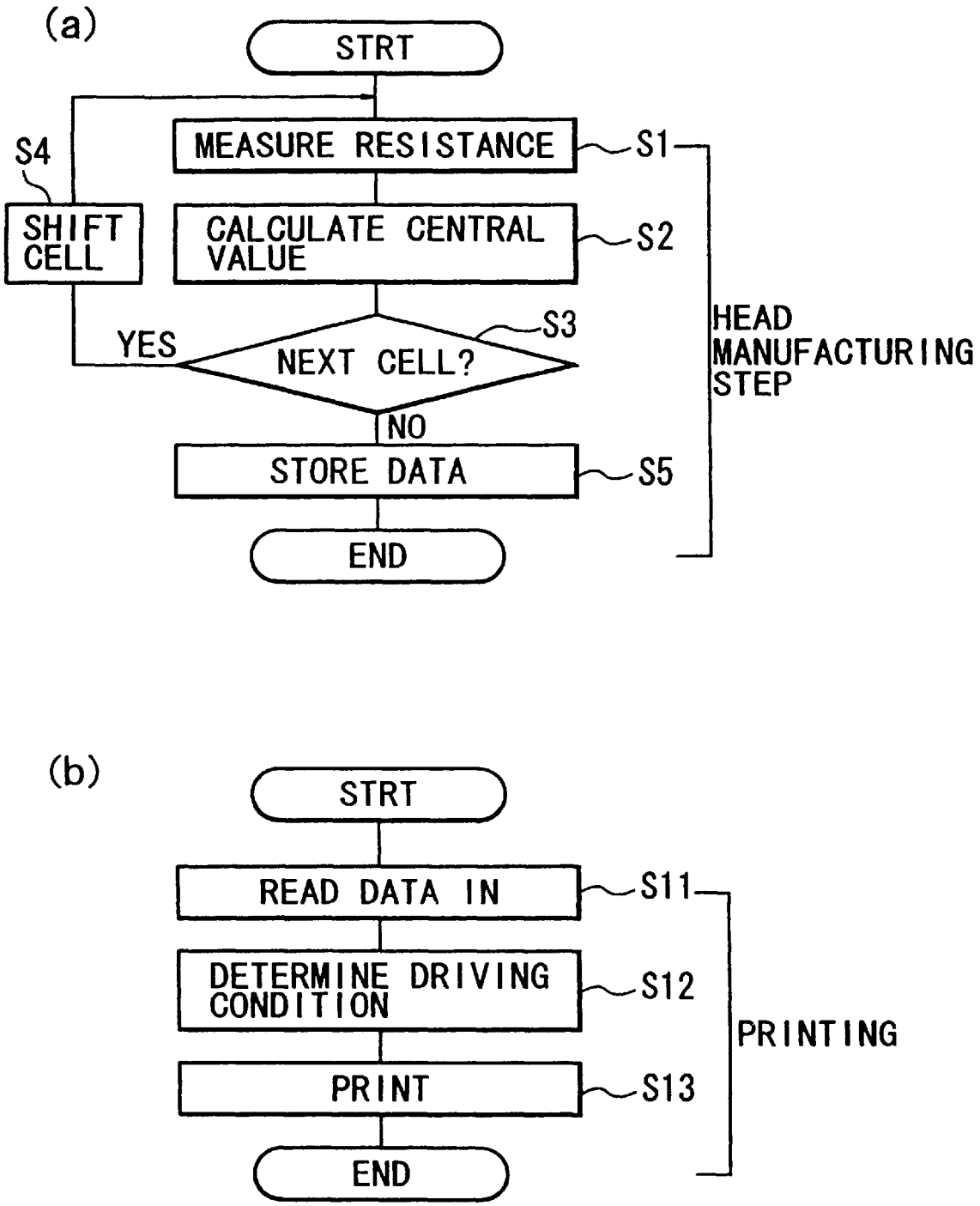
FIG. 7 includes a flow chart of measurement, processing and storing of the resistance values of the measuring elements, and a flow chart of an image printing operation in accordance with the measured data stored in memory.

Next, referring to FIGS. 6 and 7, how the resistance of each measurement element 2 is measured, how the average, median, or the referential value equivalent to the average or median, is computed, how the obtained average, median, or the referential value equivalent thereto, is stored in the memory 3, and also how the data regarding one of the properties of a measurement element is utilized in image recording, in a recording head employing the above-described recording head chip, will be described.

FIG. 6 is a drawing for showing two measured resistance values at the two points of a given cell, one for one, and the computed variance in the resistance of the portion of the substrate of a recording head chip correspondent to the given cell.

FIG. 6 shows the case of a given cell of a recording head chip which was formed from the peripheral area of a wafer. In the case of the cell shown in FIG. 6, there is a difference of 8% in resistance between the leftmost and rightmost recording elements 1 in terms of the recording element alignment direction. One of the properties, more specifically, the resistance, of each recording element 1, is estimated using the measurement elements 2 disposed at the end portions of the cell in which the recording elements 2 are aligned in a straight line. The reason the resistance of each recording element 1 is not measured directly is that each recording element 1 is connected to a driver or the like, and therefore, it is difficult to accurately measure the resistance of a recording element 1.

FIG. 7 is a flow chart for describing how the resistance of each measurement element 2 is measured, how the average, median, or the referential value equivalent to the average or median, is computed, how the obtained average or median, or the referential value equivalent thereof, is stored in the memory 3, and also how the data regarding one of the properties of a measurement element is utilized in image recording, in a recording head employing the above-described recording head chip. As shown in FIG. 7, this flow chart can be roughly divided into two sections of steps: section (a) belonging to a recording head manufacturing process, in which the resistance values of the measurement elements in each cell are measured; the average, median, or the referential value equivalent to the average or median, is computed from the measured resistance values; and the computed average, median, or the referential value equivalent to the average or median, is stored in the memory 3, and section (b) belonging to the actual recording process, in which a recording head is driven based on the data stored in the memory 3.

First, referring to section (a) of FIG. 7, in the recording head manufacturing process, the resistance values of all the measurement elements 2 (FIG. 5), which in this embodiment are the resistance values of the two measurement elements 2, are measured (S1). Then, the median (average) among the measured resistance values of the measurement elements 2 is obtained (S2). This value is kept in a buffer, and the same measurement and computation are sequentially carried out for the rest of the cells (S3, S4). After the median (average) is calculated for all the cells, the data regarding the referential values, that is, the actual medians (averages) kept in the buffer, or the codes representing the median (averages), are stored in the memory 3 (FIG. 1) in the recording head (S5).

In this embodiment, the media (average) of the resistance values of the two measurement elements 2 disposed adjacent the two end portions of the recording element array with respect to the recording element alignment direction, in each cell, is employed as the referential value, which is different from the conventional methods in which the referential value has been calculated. In the case of the conventional methods, there has been a variation of approximately 8% between the referential value and the actual resistance value of each measurement element 2, whereas in the case of this embodiment, the variation is approximately 4%, in other words, half that in the conventional methods. Further, in this embodiment, in an ink jet recording head manufacture, a plurality of measurement elements 2 are disposed, in the manner described above, in all the cells in all the ink jet recording head chips, with no exception, regardless of the degree of the variation in recording element resistance, and therefore, it is unnecessary to select a specific chip based on the degree of the variation recording element resistance. As a result, it is possible to prevent increase in production cost.

Next, referring to section (b) FIG. 7, the section of the flow chart, which is correspondent to the process in which an image is recorded (printed) using a recording apparatus in which a recording head in which the data regarding the recording element resistance have been stored as described above, will be described.

Before an actual recording operation is started, first, the recording element resistance value data for each cell is read by a recording apparatus from the memory 3 within the recording head (S11). Then, based on the read data, the driving signal determining means determines the amount of energy (driving condition for recording element 1) to be supplied to each recording element 1 (S12). In this embodiment, the length of time each recording element 1 is driven is controlled so that a proper amount of energy is supplied to each recording element 1. As described before, in this embodiment, the duration of the driving time for each recording element 1 is set in accordance with the median (average) of the resistance values of the two measurement elements 2 disposed adjacent the two recording elements at the two end portions of the recording element array, one for one, with respect to the recording element alignment, direction, in each cell. In other words, all the recording elements 1 in each cell are driven in accordance with the median (average) of the resistance values of all the recording elements in the cell. Therefore, the variance of the resistance value relative to the referential value, in each cell of an ink jet recording head chip in accordance with the present invention, becomes half that of each cell in an ink jet recording head chip which is based on the conventional technologies and is the same in cell size or chip size as an ink jet recording head chip in accordance with the present invention. Thus, even in the case of a recording head employing an ink jet recording head chip which comes from the peripheral portion of a wafer, the problem that the service life of the recording head is reduced by an excessive supply of energy to some of the recording elements 1 in the recording head does not occur. Further, the probability that poor recording occurs due to an insufficient supply, that is, a contrasting supply, of energy to some of the recording elements 1 in the recording head, is reduced. In other words, the present invention can improve the yield of the recording head, thereby reducing recording head cost.

When a recording head is driven by supplying the recording elements of the recording head with driving signals, the amount of energy of which is determined as described above, a desirable image is recorded (printed) on recording medium (S13).

Up to this point, description has been made regarding an example of an ink jet recording head chip in which each cell is provided with two measurement elements 2. However, when a wafer, which is relatively large in the thickness variance of the heat generating layer thereon, with respect to the position on the wafer, is employed, it is desired that the number of the measurement elements 2 for each cell is increased to assure that proper driving conditions can be set. In such a case, it is recommended that three or more measurement elements 2 are provided for each cell so that the average of three or more resistance values can be used for determining the driving conditions. However, in consideration of the fact that all the recording elements 1 must function normally, it is desired that the median, instead of the average, of these values is used.

Figure 15:
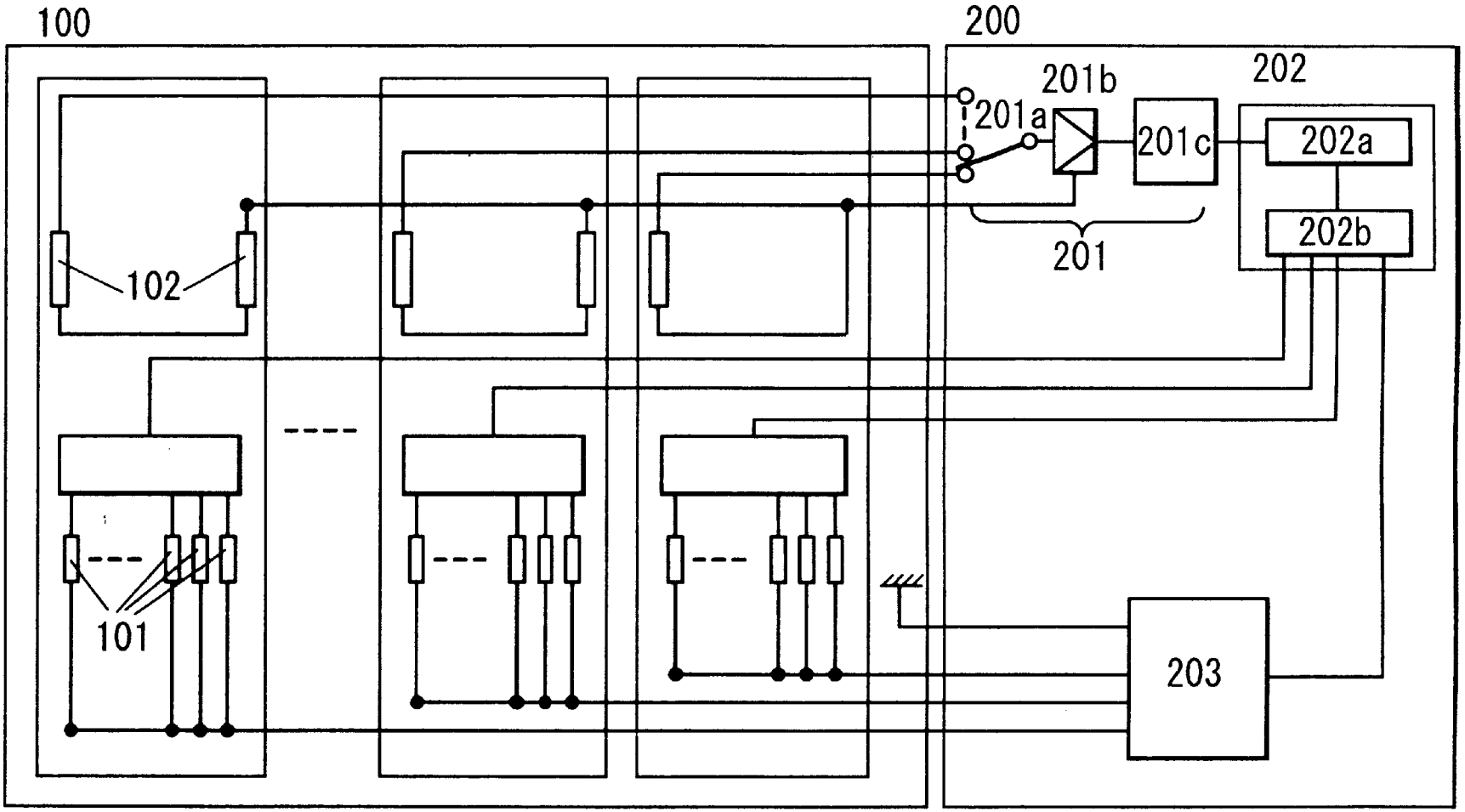
FIG. 15 is a block diagram of an ink jet recording apparatus according to an embodiment of the present invention.

Also, the descriptions given above were about a method for driving a recording head, in which the resistance of each measurement element is measured in a recording head manufacturing process; the data recording the average, or the like, of the measured resistance values is stored in the memory in the recording head; and the recording head is driven based on the data stored in the memory. Referring to FIG. 15, however, a recording head 100 may be driven under the conditions set in the following manner. That is, the properties (resistance) of the plurality of measurement elements of the recording head 100 are read during a recording operation carried out with the use of the recording head 100, and the median or average of the values of read properties is computed by a computing means 202*a* in the logic circuit 202 provided on the recording apparatus main body 200 side. Then, the driving conditions for each recording element 101 are determined by a driving signal determining means 202*b*, based on the thus obtained median or average, and each recording element 1 is driven under the determined driving conditions. In FIG. 15, a referential code 101 designates a recording element; 102, a measurement element; 103, a driver circuit for selectively driving a plurality of recording elements to 101, based on the recording signals inputted from the recording apparatus main assembly 200; 201, a measurement element resistance measuring means; 201*a*, a switch for selecting the measurement elements 102 in each cell to be connected to the recording apparatus main assembly 200; 201*b*, an amplifier for amplifying the signals reflecting the resistance value of the selected measurement element 102; 201*c*, an A/D converter for converting, in form, the signals reflecting the resistance value of the measurement element 102, which is in the analog form and has been amplified by the amplifier 201*b*, from analog to digital; and 203, a referential code that designates an electrical power source for generating driving signals to be applied to the recording elements 101.

(Miscellaneous Embodiments)

In the structure shown in FIG. 1, each cell is provided with two measurement elements 2 disposed adjacent the two end portions of the recording element array, one for one, with respect to the recording element alignment direction, in each cell. Therefore, two measurement elements 2 are positioned close to each other across the border between the adjacent two cells. In the case of this structure, the area between the two measurement elements 2 positioned across the border between the adjacent two cells becomes a so-called vacuum in terms of resistance measurement, and therefore, it is difficult to precisely know the variance in the resistance values of the recording elements 1 disposed in the areas of the cells correspondent to the resistance measurement vacuum.

In order to eliminate this problem, it is feasible to structure an ink jet recording head chip so that only one measurement element 1 is disposed adjacent to the border between the two adjacent cells, instead of disposing two measurement elements adjacent to each other across the border between the adjacent two cells, as described above, and this single measurement element 1 is shared by the adjacent two cells. This structural arrangement eliminates the "resistance measurement vacuum", making it possible to precisely know the variance in resistance value of more recording elements 1.

While the invention has been described with reference to the structures disclosed herein, it is not confined to the details set forth and this application is intended to cover such modifications or changes as may come within the purpose of the improvements or the scope of the following claims.

What is claimed is:

1. An ink jet recording head comprising:

a substrate;

a plurality of recording elements arranged in an array on said substrate, said recording elements having electric resistances with a variance not less than 4% from a resistance of at least one of said recording elements, wherein the recording elements generate ink ejection energy to effect recording;

a plurality of reference elements disposed adjacent at least each of the opposite ends of the array of said recording elements and having electric resistances corresponding to the electric resistances of said recording elements; and storing means for storing the electric resistances of said reference elements, a median thereof or a reference value corresponding to the median, wherein the median or the reference value are available for determination of amounts of electric energy of actuating signals to be supplied to the recording elements to generate the ink ejection energy.

2. An ink jet recording head according to claim 1, wherein said recording elements comprise heat generating elements.

3. An ink jet recording head according to claim 1, wherein the array of the recording elements has a length not less than 20 mm.

4. An ink jet recording head according to claim 1, wherein an additional reference element is disposed between said reference elements disposed adjacent to the ends of the array of the recording elements.

5. An ink jet recording head according to claim 1, wherein measuring electrodes are connected to opposite ends of each of the reference elements.

6. An ink jet recording head according to claim 1, wherein a measuring electrode is connected to one end of each of the reference elements disposed adjacent the opposite ends of the array of the recording elements, wherein the other ends of the reference elements are connected by wiring.

7. An ink jet recording head according to claim 6, wherein the resistance of the wiring is not more than 1/10 a total of the resistances of the reference elements.

8. An ink jet recording head according to claim 1, wherein said array of the recording elements is divided into a plurality of groups of said recording elements, and said plurality of reference elements are disposed at least at the opposite ends of the respective groups of the recording elements.

9. An ink jet recording head according to claim 8, wherein at least one recording element driving signal contact is connected to each of the groups of said recording elements to supply driving signals for generating the ejection energy to said recording elements therein with the same pulse width to cause said recording elements to generate the ejection energy.

10. An ink jet recording head according to claim 8, wherein the groups of the recording elements have a length not less than 20 mm.

11. An ink jet recording apparatus comprising:

a recording head, including a substrate;

a plurality of recording elements arranged in an array on said substrate, said recording elements having electric resistances with a variance not less than 4% from a resistance of at least one of said recording elements, wherein the recording elements generate ink ejection energy to effect recording; and a plurality of reference elements disposed adjacent at least each of the opposite ends of the array of said recording elements and having electric resistances corresponding to the electric resistances of said recording elements, wherein actuating signals of electric energy determined on the basis of a median of the electric resistances of said reference elements are supplied to said recording elements to generate the ejection energy.

12. An ink jet recording apparatus according to claim 11, wherein said recording elements comprise heat generating elements.

13. An ink jet recording apparatus according to claim 11, wherein the array of the recording elements has a length not less than 20 mm.

14. An ink jet recording apparatus according to claim 11, wherein an additional reference element is disposed between said reference elements disposed adjacent to the ends of the array of the recording elements.

15. An ink jet recording apparatus according to claim 11, wherein measuring electrodes are connected to opposite ends of each of the reference elements.

16. An ink jet recording apparatus according to claim 11, wherein a measuring electrode is connected to one end of the reference elements disposed adjacent the opposite ends of the array of the recording elements, wherein the other ends of the reference elements are connected by wiring.

17. An ink jet recording apparatus according to claim 16, wherein the resistance of the wiring is not more than 1/10 a total of the resistances of the measuring elements.

18. An ink jet recording apparatus according to claim 11, wherein said array of the recording elements is divided into a plurality of groups of said recording elements, and said plurality of reference elements are disposed at least at the opposite ends of the respective groups of the recording elements.

19. An ink jet recording apparatus according to claim 18, wherein at least one recording element driving signal contact is connected to each of the groups of said recording elements to supply driving signals for generating the ejection energy to said recording elements therein with the same pulse width to cause said recording elements to generate the ejection energy.

20. An ink jet recording apparatus according to claim 19, wherein the amounts of the electric energy of the driving signals to be supplied to said recording elements are capable of being controlled for respective groups.

21. An ink jet recording apparatus according to claim 19, wherein the amounts of the electric energy of the driving signals to be supplied to said recording elements are the same within the respective groups.

22. An ink jet recording apparatus according to claim 18, further comprising storing means for storing the median or the reference value corresponding thereto.

23. An ink jet recording apparatus according to claim 18, wherein said recording elements comprise heat generating elements.

24. An ink jet recording apparatus according to claim 18, wherein the groups of the recording elements have a length not less than 20 mm.

25. An ink jet recording apparatus according to claim 18, wherein an additional reference element is disposed between said reference elements disposed adjacent to the ends of the array of the recording elements.

26. An ink jet recording apparatus according to claim 18, wherein measuring electrodes are connected to opposite ends of each of the reference elements.

27. An ink jet recording apparatus according to claim 18, wherein a measuring electrode is connected to one end of each of the reference elements disposed adjacent the opposite ends of the array of the recording elements, wherein the other ends of the reference elements are connected by wiring.

28. An ink jet recording apparatus according to claim 27, wherein the resistance of the wiring is not more than 1/10 a total of the electric resistances of the reference elements.

29. A manufacturing method for an ink jet recording head including a substrate, a plurality of recording elements arranged in an array on the substrate, the recording elements having electric resistances with a variance not less than 4% from a resistance of at least one of the recording elements, wherein the recording elements generate ink ejection energy to effect recording, a plurality of reference elements disposed adjacent at least each of the opposite ends of the array of the recording elements and having electric resistances corresponding to the electric resistances of the recording elements, and storing means for storing the resistances of the reference elements, a median thereof or a reference value corresponding to the median, wherein the median or the reference value are available for determination of amounts of electric energy of actuating signals to be supplied to the recording elements to generate the ink ejection energy, said method comprising:

a step of measuring the electric resistances of the plurality of reference elements;

a step of calculating a median of the electric resistances of the reference elements or a reference value corresponding to the median from measured resistances of the reference elements; and a step of storing in the storing means the median or the reference value.

30. A method according to claim 29, wherein the recording elements and the reference elements are produced in a same process step.

31. A method according to claim 29, wherein the array of the recording elements has a length not less than 20 mm.

32. A method according to claim 29, wherein an additional reference element is disposed between the reference elements disposed adjacent to the ends of the array of the recording elements.

33. A method according to claim 29, wherein measuring electrodes are connected to opposite ends of each of the reference elements.

34. A method according to claim 29, wherein a measuring electrode is connected to one end of each of the reference elements disposed adjacent the opposite ends of the array of the recording elements, wherein the other ends of the reference elements are connected by wiring.

35. A method according to claim 34, wherein the resistance of the wiring is not more than 1/10 a total of the electric resistances of the reference elements.

36. A method according to claim 29, wherein the array of the recording elements is divided into a plurality of groups of the recording elements, and the plurality of reference elements are disposed at least at the opposite ends of the respective groups of the recording elements.

37. A method according to claim 36, wherein at least one recording element driving signal contact is connected to each of the groups of the recording elements to supply driving signals for generating the ejection energy to the recording elements therein with the same pulse width to cause the recording elements to generate the ejection energy.

38. A method according to claim 36, wherein the groups of the recording elements have a length not less than 20 mm.

39. A driving method for an ink jet recording head including a substrate having a plurality of recording elements arranged in an array on a substrate, the recording elements having electric resistances with a variance not less than 4% from a resistance of at least one of the recording elements, wherein the recording elements generate ink ejection energy to effect recording, and a plurality of reference elements disposed adjacent at least each of the opposite ends of the array of the recording elements and having electric resistances corresponding to the electric resistances of the recording elements, said method comprising:

a step of determining amounts of electric energy of driving signals to be supplied to the recording elements to generate the ejection energy on the basis of a median of the electric resistance of the reference elements or a reference value corresponding to the median; and a step of supplying the driving signals having the amounts of electric energy determined in said determining step to the recording elements.

40. A method according to claim 39, wherein the recording head further includes storing means for storing the median or the reference value corresponding thereto, said method further comprising a step of reading out the median or the reference value corresponding thereto out of said storing means before said determining step.

41. A method according to claim 39, wherein the array of the recording elements is divided into a plurality of groups of the recording elements, and the plurality of reference elements are disposed at least at the opposite ends of the respective groups of the recording elements.

42. A method according to claim 41, wherein at least one recording element driving signal contact is connected to each of the groups of the recording elements to supply driving signals for generating the ejection energy to the recording elements therein with the same pulse width to cause the recording elements to generate the ejection energy.

43. A method according to claim 41, wherein the groups of the recording elements have a length not less than 20 mm.

44. A method according to claim 41, wherein the amounts of the electric energy of the driving signals to be supplied to the recording elements are capable of being controlled for respective groups.

45. A method according to claim 41, wherein the amounts of the electric energy of the driving signals to be supplied to the recording elements are the same within the respective groups.

46. An apparatus according to claim 11, further comprising storing means storing the electric resistances of said reference elements, the median thereof or a reference value corresponding to the median.

47. An apparatus according to claim 11, further comprising calculating means for calculating the median of the resistances of said reference elements or a reference to the median.

48. An apparatus according to claim 47, further comprising measuring means for measuring the resistances of said reference elements.

49. A method according to claim 39, further comprising a step of detecting the electric resistances of the reference elements.

50. An ink jet recording head comprising:

a substrate;

a plurality of recording elements arranged in an array on said substrate, wherein the recording elements generate ink ejection energy to effect recording;

a plurality of reference elements disposed adjacent at least each of the opposite ends of the array of said recording elements and having electric resistances corresponding to the electric resistances of said recording elements; and storing means for storing the electric resistances of said reference elements, a median therof or a reference value corresponding to the median, wherein the median or the reference value are available for determination of amounts of electric energy of actuating signals to be supplied to said recording elements to generate the ink ejection energy.

51. An ink jet recording to claim 50, wherein one of said recording elements has an electric resistance which is at variance not less than 4% with at least another one of said recording elements on said substrate.

52. An ink jet recording head according to claim 50, wherein said substrate has a length not less than 20 mm.

53. An ink jet recording apparatus comprising:

a recording head including a substrate, a plurality of recording elements arranged in an array on said substrate, wherein said recording elements generate ink ejection energy to effect recording, and a plurality of reference elements disposed adjacent at least each of the opposite ends of the array of said recording elements and having electric resistance corresponding to the electric resistance of said recording elements, wherein actuating signals of electric energy determined on the basis of a median of the electric resistances of said reference elements are supplied to said recording elements to generate the ejection energy.

54. A manufacturing method for an ink jet recording head including a substrate, a plurality of recording elements arranged in an array on the substrate, wherein the recording elements generate ink ejection energy to effect recording, a plurality of reference elements disposed adjacent at least each of the opposite ends of the array of the recording elements and having electric resistances corresponding to the electric resistances of the recording elements, and storing means for storing the electric resistances of the reference elements, a median thereof or a reference value corresponding to the median, wherein the median or the reference value are available for determination of amounts of electric energy of actuating signals to be supplied to the recording elements to generate the ink ejection energy, said method comprising:

a step of measuring the electric resistances of the plurality of reference elements;

a step of calculating the median of the electric resistances of the reference elements or the reference value corresponding to the median from measured resistances of the reference elements; and

55. A driving method for an ink jet recording head including a substrate having a plurality of recording elements arranged in an array on the substrate, wherein the recording elements generate ink ejection energy to effect recording, and a plurality of reference elements disposed adjacent at least each of the opposite ends of the array of the recording elements and having electric resistances corresponding to the electric resistances of the recording elements, said method comprising:

a step of determining amounts of electric energy of driving signals to be supplied to the recording elements to generate the ejection energy on the basis of a median of the electric resistances of the reference elements or a reference value corresponding to the median; and a step of supplying the driving signals having the amounts of electric energy determined in said determining step to the recording elements.

* * * * *

UNITED STATES PATENT AND TRADEMARK OFFICE

CERTIFICATE OF CORRECTION

PATENT NO. : 6,688,720 B2
DATED : February 10, 2004
INVENTOR(S) : Imanaka et al.

It is certified that error appears in the above-identified patent and that said Letters Patent is hereby corrected as shown below:

Column 1,
Line 46, “or” should read -- of --.

Column 3,
Line 15, “inventors” should read -- inventors’ --.

Column 5,
Line 41, “comprises” should read -- comprise --.

Column 6,
Line 61, “from” should read -- from a --.

Column 7,
Line 37, “in” should be deleted.

Column 12,
Line 41, “signals” should read -- signal --.

Column 19,
Line 25, “resistance” should read -- resistances --.
Line 63, “to” should read -- value corresponding to --.

Column 20,
Line 37, “resistance” should read -- resistances --.
Line 54, “are” should read -- is --.
Line 63, “and” should read
-- and
a step of storing in the storing means the median or the reference value. --.

Signed and Sealed this

Twenty-third Day of November, 2004

JON W. DUDAS
*Director of the United States Patent and Trademark Office*